US007815280B2

(12) United States Patent
Hayashi et al.

(10) Patent No.: US 7,815,280 B2
(45) Date of Patent: Oct. 19, 2010

(54) LIQUID-DISCHARGE-FAILURE DETECTING APPARATUS AND INKJET RECORDING APPARATUS

(75) Inventors: Hirotaka Hayashi, Nagoya (JP); Kazumasa Ito, Tajimi (JP)

(73) Assignee: Ricoh Elemex Corporation, Nagoya-shi (JP)

( * ) Notice: Subject to any disclaimer, the term of this patent is extended or adjusted under 35 U.S.C. 154(b) by 185 days.

(21) Appl. No.: 12/247,614

(22) Filed: Oct. 8, 2008

(65) Prior Publication Data

US 2009/0091595 A1 Apr. 9, 2009

(30) Foreign Application Priority Data

Oct. 9, 2007 (JP) ..... 2007-263263

(51) Int. Cl.
*B41J 2/01* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 4,510,504 A | | 4/1985 | Tamai et al. | |
| 5,304,814 A | * | 4/1994 | Markham | 250/573 |
| 5,621,524 A | * | 4/1997 | Mitani | 356/338 |
| 5,627,571 A | * | 5/1997 | Anderson et al. | 347/19 |
| 6,322,190 B1 | * | 11/2001 | Kono et al. | 347/19 |
| 6,513,900 B2 | * | 2/2003 | Endo et al. | 347/19 |
| 7,490,918 B2 | * | 2/2009 | Nagashima | 347/19 |
| 2006/0023046 A1 | | 2/2006 | Miura et al. | |

FOREIGN PATENT DOCUMENTS

| | | | |
|---|---|---|---|
| EP | 0 461 437 A2 | | 12/1991 |
| JP | 2005-280351 A | | 10/2005 |
| JP | 2006-47235 | * | 2/2006 |
| JP | 2006-346906 A | | 12/2006 |
| JP | 2007-111971 | * | 5/2007 |
| JP | 2007-111971 A | | 5/2007 |

* cited by examiner

*Primary Examiner*—Huan H Tran
(74) *Attorney, Agent, or Firm*—Foley & Lardner LLP

(57) ABSTRACT

A liquid-discharge-failure detecting apparatus detects a liquid discharge failure. A light-emitting element emits a beam onto a droplet of liquid discharged from a liquid-droplet-discharge surface with an optical axis of the beam making a right angle with a direction in which the droplet is discharged. A light-receiving element receives a scattered light generated by scattering of the beam by the droplet. A failure detecting unit detects the liquid discharge failure from data of the scattered light received by the light-receiving element. A distance changing unit changes a distance between the liquid-droplet-discharge surface and the optical axis of the beam based on, for example, a diameter of the droplet.

5 Claims, 8 Drawing Sheets

LIQUID-DISCHARGE-FAILURE DETECTING APPARATUS AND INKJET RECORDING APPARATUS

CROSS-REFERENCE TO RELATED APPLICATIONS

The present application claims priority to and incorporates by reference the entire contents of Japanese priority document 2007-263263 filed in Japan on Oct. 9, 2007.

BACKGROUND OF THE INVENTION

1. Field of the Invention

The present invention relates to a technology for detecting a liquid discharge failure in an inkjet recording apparatus.

2. Description of the Related Art

In a technology disclosed in Japanese Patent Application Laid-open No. 2006-346906, a light-emitting element and a light-receiving element are arranged in such a manner that a passage of an ink droplet discharged from a recording head is located between them. In a light path from the light-emitting element to the light-receiving element, a first plate with an aperture is arranged near the light-emitting element and a second plate with a plurality of apertures is arranged near the light-receiving element. The apertures formed on the second plate are arranged on a line that is parallel to a direction in which the ink droplet is discharged. The light-emitting element emits two light beams toward the light-receiving element. The light-receiving element receives the two light beams and generates an output based on intensity of received light. The intensity of light received by the light-receiving element, and therefore the output of the light-receiving element, varies depending on the degree of blocking of the light beams by an ink droplet. In other words, a misdischarge, an oblique discharge, and a discharge speed can be detected from the variations in the output of the light-receiving element.

Japanese Patent Application Laid-open No. 2005-280351 discloses a liquid-droplet detecting apparatus for detecting a droplet of liquid. Specifically, the liquid-droplet detecting apparatus includes a liquid-droplet discharging unit that discharges a droplet from a liquid-droplet-discharge surface, a detecting unit that generates a detection signal indicative of a state of the droplet, an optical system, and a discharge determining unit that determines a state of discharge based on the detection signal. The detecting unit includes a light-emitting element and a light-receiving element. The light-emitting element emits a light beam toward the light-receiving element so that an optical axis of the light beam is substantially perpendicular to the direction in which the droplet is discharged from the liquid-droplet-discharge surface and the optical axis is substantially parallel to the liquid-droplet-discharge surface. The optical system converts the light beam to a parallel light with a cross-section having a longitudinal axis parallel to the direction in which the droplet is discharged.

However, in the technology disclosed in Japanese Patent Application Laid-open No. 2006-346906, the intensity of received light decreases when the light beams are out of the aperture. Such a change that does not reflect a displacement amount (change) of the ink droplet within the aperture reduces the accuracy of detection. Various apertures are required to solve this problem. Moreover, in the technologies disclosed in Japanese Patent Application Laid-open Nos. 2006-346906 and 2005-280351, it is difficult to determine a discharge error in the event of the oblique discharge because the displacement amount of the droplet on or near the head nozzle surface is still small and a remarkable change does not appear in the detection signal.

SUMMARY OF THE INVENTION

It is an object of the present invention to at least partially solve the problems in the conventional technology.

According to an aspect of the present invention, there is provided a liquid-discharge-failure detecting apparatus that detects a liquid discharge failure from a liquid-droplet-discharge surface. The liquid-discharge-failure detecting apparatus includes a light-emitting element that emits a beam onto a droplet of liquid discharged from the liquid-droplet-discharge surface with an optical axis of the beam making a right angle with a direction in which the droplet is discharged; a light-receiving element that receives a scattered light generated by scattering of the beam by the droplet and outputs a signal indicative of an intensity of received scattered light; a failure detecting unit that detects the liquid discharge failure by analyzing the signal output from the light-receiving element; and a distance changing unit that changes a distance between the liquid-droplet-discharge surface and the optical axis of the beam.

According to another aspect of the present invention, there is provided an inkjet recording apparatus that includes the above liquid-discharge-failure detecting apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
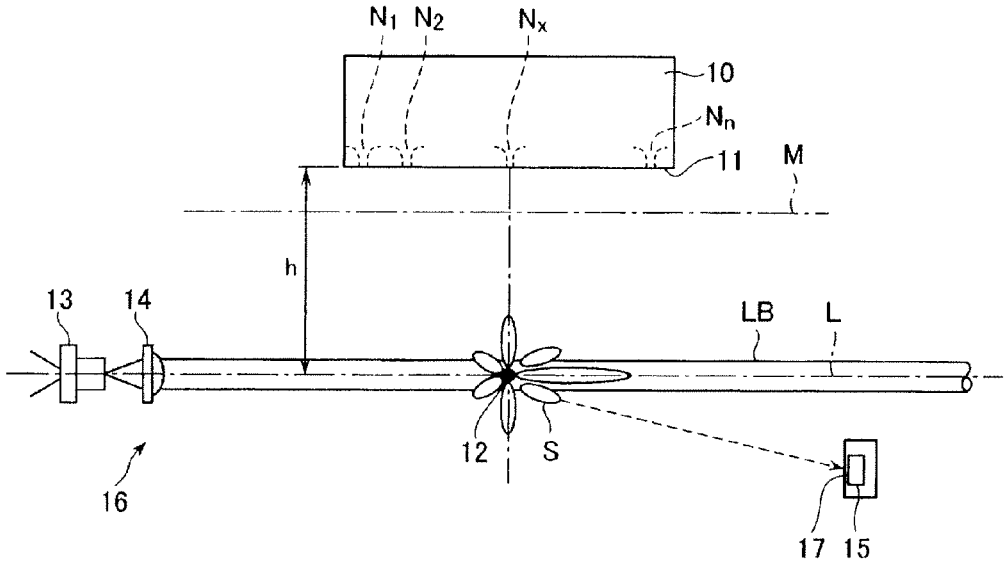
FIG. 1 is a schematic diagram of a liquid-discharge-failure detecting apparatus incorporated in an inkjet recording apparatus according to a first embodiment of the present invention.

FIG. 1 is a schematic diagram of a liquid-discharge-failure detecting apparatus 16 incorporated in an inkjet recording apparatus according to a first embodiment of the present invention.

The inkjet recording apparatus includes an inkjet head 10. A bottom surface of the inkjet head 10 is a head nozzle surface 11 as a liquid-droplet-discharge surface. On the head nozzle surface 11, a plurality of nozzles N1, N2, . . . , Nx, . . . , and Nn are arranged on a line (hereinafter, "nozzle line") at regular intervals with each other. Ink droplets are discharged from the nozzles N1 to Nn. In the example shown in FIG. 1, an ink droplet 12 is discharged from the nozzle Nx.

The liquid-discharge-failure detecting apparatus 16 is arranged below the inkjet head 10. The liquid-discharge-failure detecting apparatus 16 includes a light-emitting element 13, a collimating lens 14, and a light-receiving element 15. The light-emitting element 13 can be a laser diode (LD) or a light-emitting diode (LED). The light-receiving element 15 can be a photodiode (PD). The light-emitting element 13 emits a light, and the collimating lens 14 collimates the light into a parallel laser beam LB.

The light-emitting element 13 emits the light beam LB to the ink droplet 12 at about a right angle with respect to a direction in which the discharged ink droplet 12 is discharged from the head nozzle surface 11 (hereinafter, "discharge direction"). In other words, an optical axis L of the laser beam LB is parallel to the nozzle line. In the example shown in FIG. 1, the laser beam LB travels on a normal printing surface M that is located on a level at a distance h between the head nozzle surface 11 and the optical axis L being, for example, 1 mm.

The light-receiving element 15 is arranged on a position where a receiving surface 17 of the light-receiving element 15 is out of a passage of the laser beam LB but close to the optical axis L as much as possible to detect a liquid discharge failure efficiently.

When the ink droplet 12 is discharged from the nozzle Nx and the laser beam LB strikes the discharged ink droplet 12, the laser beam LB generates a scattered light S. The receiving surface 17 receives the scattered light S. More particularly, the receiving surface 17 receives a forward scattered light out of the scattered light S. The liquid-discharge-failure detecting apparatus 16 obtains data of the scattered light S by measuring an optical output of the light-receiving element 15, and detects various liquid discharge failures based on the data, for example, a misdischarge and an oblique discharge.

Figure 2:
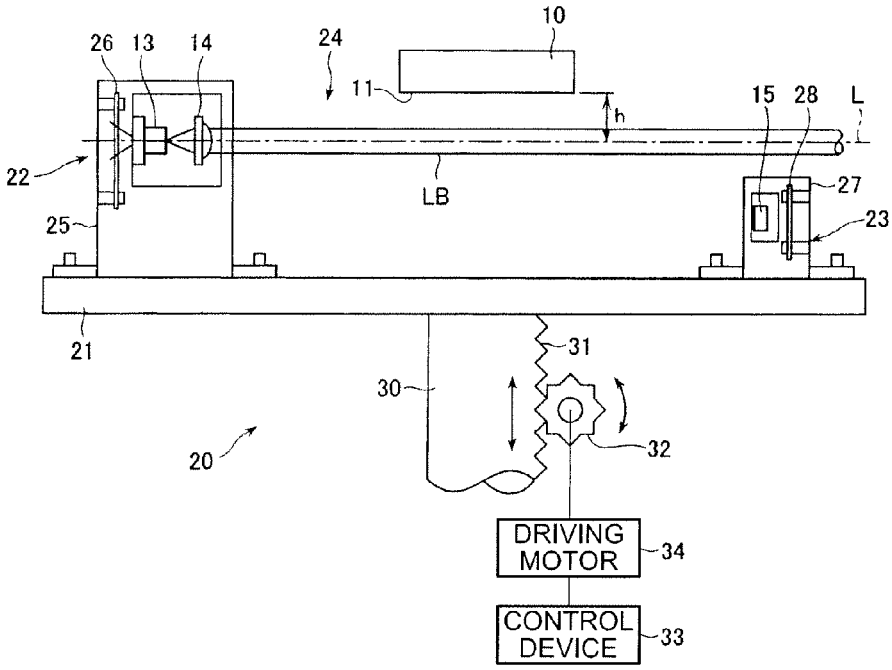
FIG. 2 is a schematic diagram of a distance changing unit incorporated in the liquid-discharge-failure detecting apparatus shown in FIG. 1.

FIG. 2 is a schematic diagram of a distance changing unit 20 incorporated in the liquid-discharge-failure detecting apparatus 16. The distance changing unit 20 includes a base 21 and an optical device 24 arranged on the base 21. The optical device 24 includes an LD unit 22 and a PD unit 23. The LD unit 22 includes the light-emitting element 13, the collimating lens 14, and an LD driving circuit 26 arranged inside an LD case 25. The PD unit 23 includes the light-receiving element 15 and a PD driving circuit 28 arranged inside a PD case 27.

The base 21 is supported by a substantially vertical supporting shaft 30. A rack 31 is provided on the supporting shaft 30 and a pinion 32 engages with the rack 31. The pinion 32 is driven by a driving motor 34 under control of a control device 33. The supporting shaft 30, and therefore the base 21, moves up or down with the rotation of the pinion 32.

Upon receiving information about the ink droplet 12 that is going to be discharged, the control device 33 causes the driving motor 34 to rotate the pinion 32 based on the received information. The information about the ink droplet 12 can be a diameter and a discharge speed of the ink droplet 12. The base 21 moves up or down as the pinion 32 rotates. In this manner, the distance h between the head nozzle surface 11 and the optical axis L can be adjusted to a target value.

It is assumed that the ink droplet 12 discharged from the nozzle Nx is to be detected on the normal printing surface M in a first case, and the ink droplet 12 is to be detected on a level N that is lower than the normal printing surface M.

Figure 3:
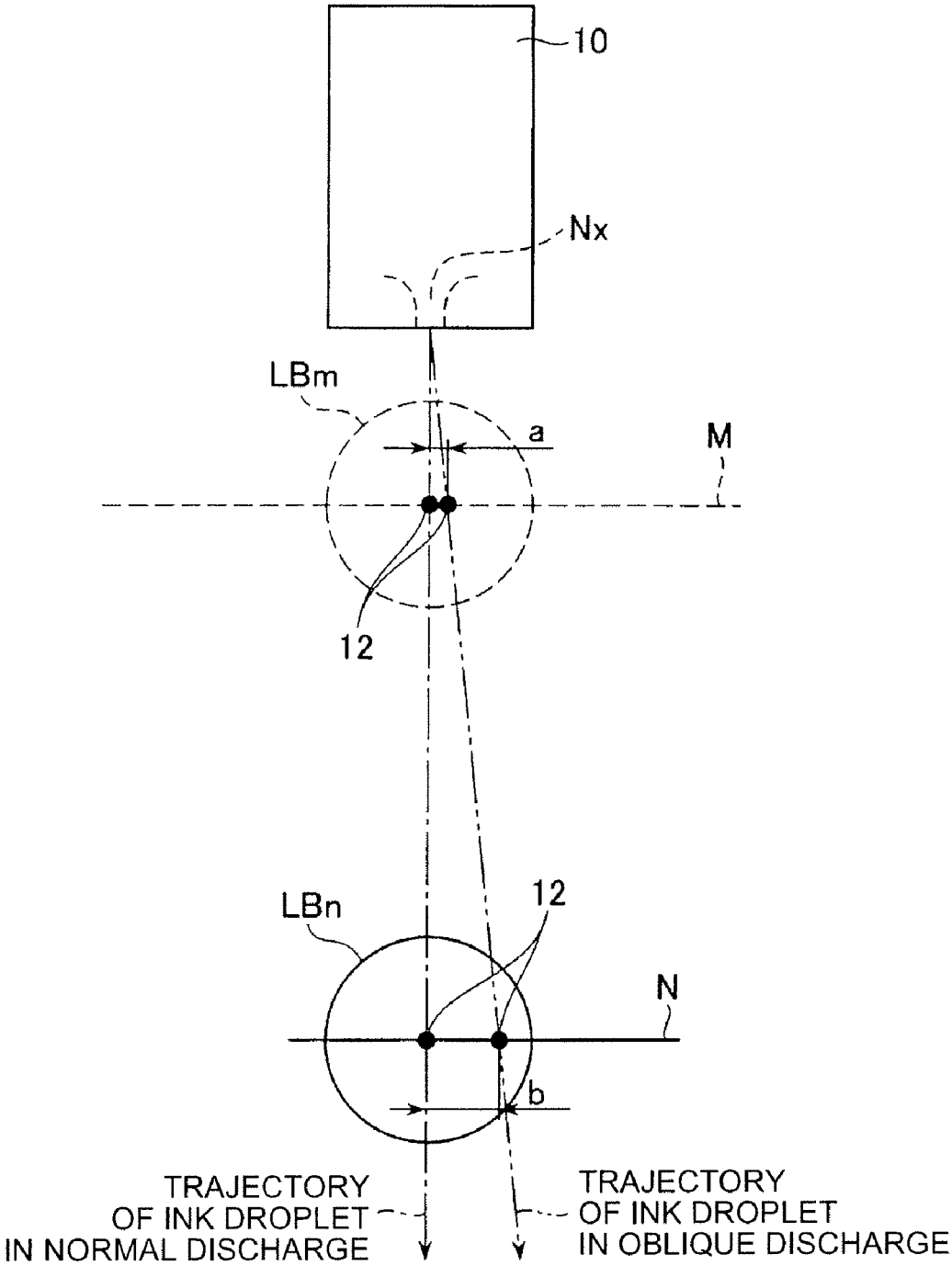
FIG. 3 is a schematic diagram for explaining a first case where an ink droplet discharged from a nozzle of the inkjet recording apparatus is detected on a normal printing surface and a second case where the ink droplet is detected on a lower level than the normal printing surface.

As shown in FIG. 3, a one-dot line is a trajectory of the ink droplet 12 in the normal discharge; and a two-dot line is a trajectory of the ink droplet 12 in the oblique discharge. The laser beam LB travelling on the normal printing surface M is called laser beam LBm; and the laser beam LB travelling on the level N is called laser beam LBn. In the oblique discharge, a position at which the ink droplet 12 hits on the laser beam LB (hereinafter, "hit position") is displaced from the hit position in the normal discharge. As shown in FIG. 3, a distance between the hit positions in the oblique discharge and the normal discharges (hereinafter, "displacement amount") increases, as the distance h increases. That is, a displacement amount b on the level N is larger than a displacement amount a on the normal printing surface M.

Figure 4:
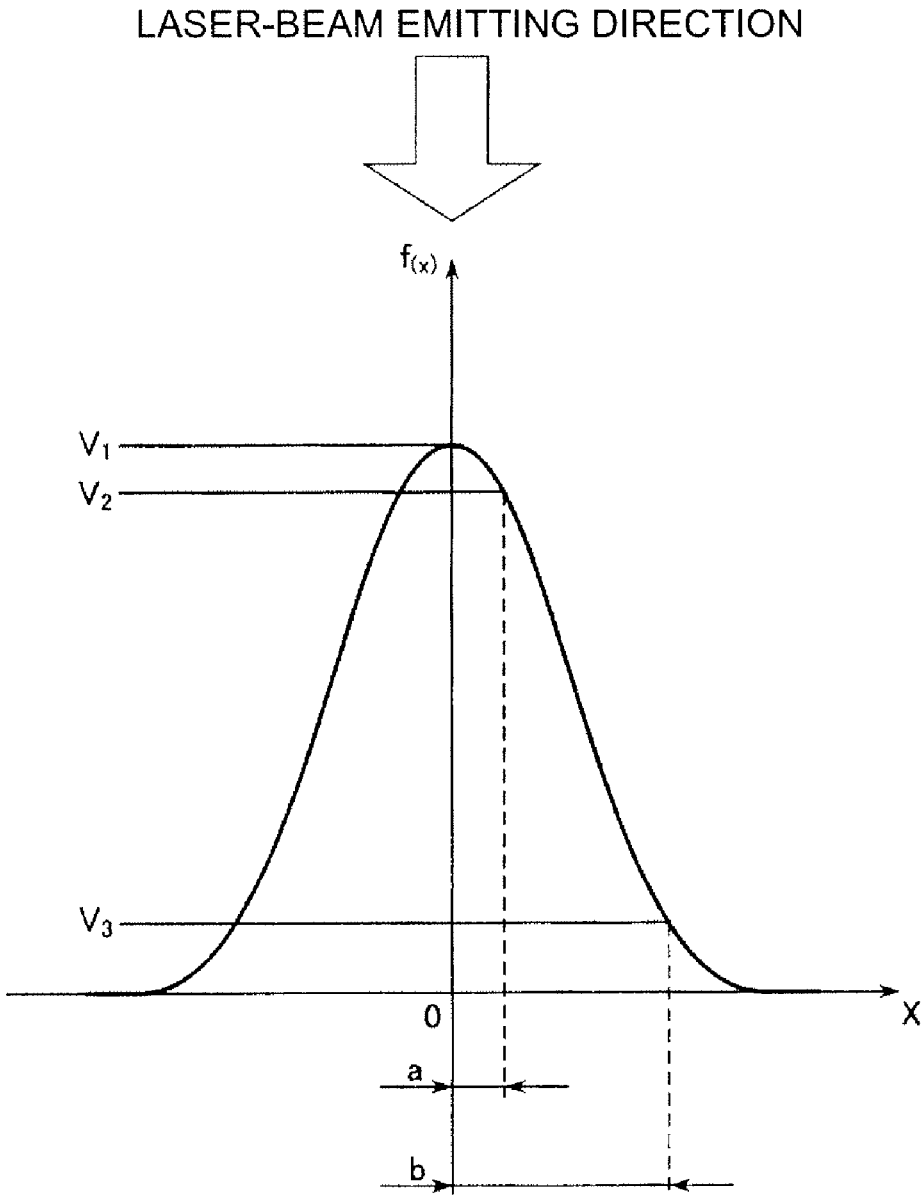
FIG. 4 depicts light intensity distribution of a laser beam shown in FIG. 3.

FIG. 4 depicts light intensity distribution of the laser beam LB. The light intensity distribution is a Gaussian distribution. The intensity of the light beam LB increases to the highest at the center, and decreases as it goes to the circumference. As shown in FIG. 3, the hit position in the normal discharge is on the center, while the hit position in the oblique discharge is displaced from the center by the displacement amount. If the laser beam LBm is used, the optical output value obtained in the normal discharge is $V_1$, while the optical output value obtained in the oblique discharge is $V_2$, where $V_1$ is higher than $V_2$. If the laser beam LBn is used, the optical output value obtained in the oblique discharge is $V_3$, where $V_2$ is higher than $V_3$. Because the displacement amount b is larger than the displacement amount a, the decreased amount in the laser beam LBn is larger than the decreased amount in the laser beam LBm.

Figure 5A:
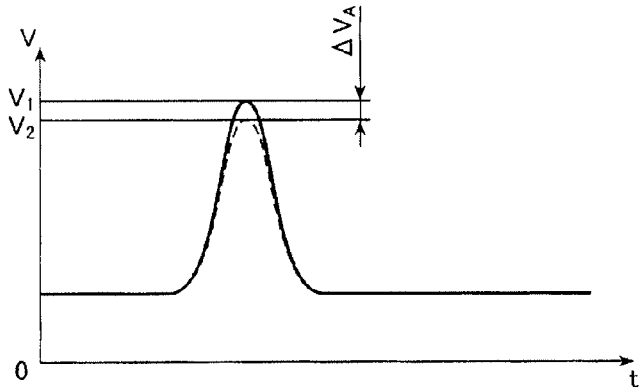
FIG. 5A depicts optical output characteristics on the normal printing surface shown in FIG. 3.
Figure 5B:
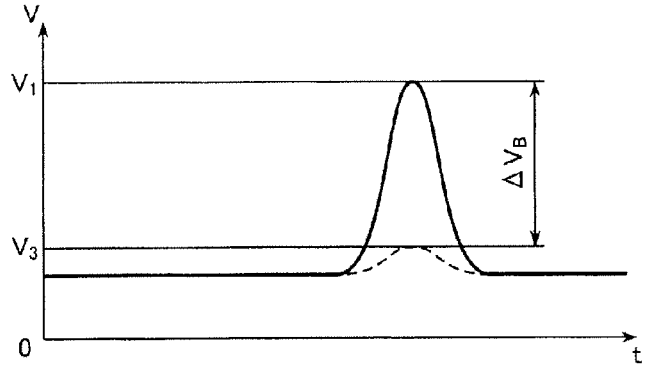
FIG. 5B depicts optical output characteristics on the lower level shown in FIG. 3.

FIG. 5A depicts optical output characteristics on the normal printing surface M; and FIG. 5B depicts optical output characteristics on the level N. The horizontal axis is time t since the ink droplet 12 is discharged, and the vertical axis is optical output value V.

As shown in FIGS. 5A and 5B, $\Delta V_A$ is smaller than $\Delta V_B$. $\Delta V_A$ is a difference between $V_1$ and $V_2$ and $\Delta V_B$ is a difference between $V_1$ and $V_3$. In other words, even when a slight change appears on the normal printing surface M, an obvious change appears on the level N. The equivalent value same as $\Delta V_B$ can be obtained on the normal printing surface M, if a laser beam with an extremely small diameter is used. However, because the light-emitting element capable of emitting the extremely small-diameter laser beam is expensive, the detection on the level N is recommended from the viewpoint of cost reduction.

Figure 6:
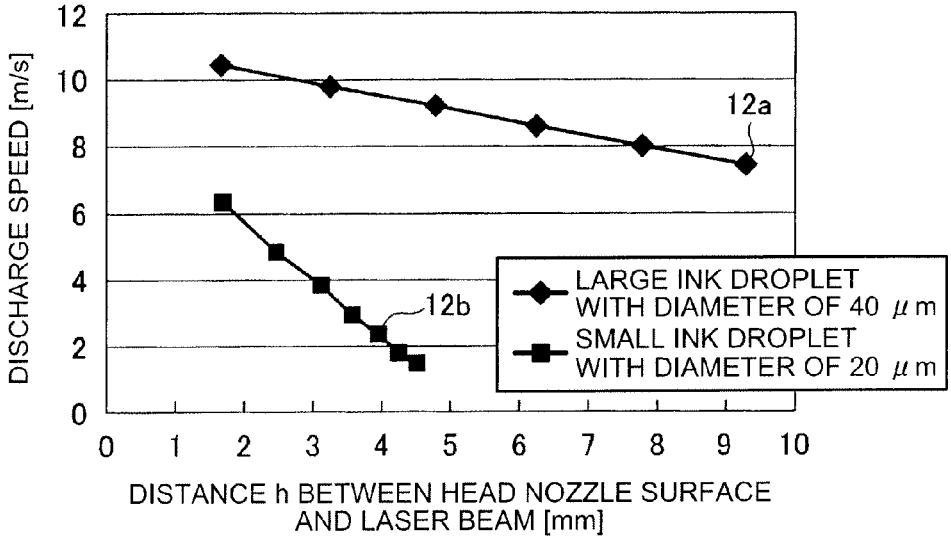
FIG. 6 is a graph for comparing a discharge speed of a large ink droplet with the diameter of 40 μm with a discharge speed of a small ink droplet with the diameter of 20 μm.

FIG. 6 is a graph for comparing the discharge speed of a large ink droplet 12*a* with the diameter of 40 μm with the discharge speed of a small ink droplet 12*b* with the diameter of 20 μm. The horizontal axis is distance h, and the vertical axis is discharge speed.

It is clear from FIG. 6 that the discharge speed of an ink droplet depends on the diameter of the ink droplet. The large ink droplet 12*a* travels at a substantially constant speed, and therefore the large ink droplet 12*a* is detected even when the distance h is large. On the other hand, the small ink droplet 12*b* travels slower than the large ink droplet 12*a* and the discharge speed decreases remarkably as it travels. As a result, at a point of the distance h being about 5 mm, the small ink droplet 12*b* floats, i.e., travels in any direction other than the discharge direction due to airflow caused by a fan, a heat source, or the like.

In this manner, if the distance h is larger and the ink droplet 12 has smaller diameter and slower discharge speed, the ink droplet 12 may float before reaching the laser beam LB, which results in a detection error. Therefore, it is necessary to adjust the distance h depending on the diameter and the discharge speed of an ink droplet. More particularly, the distance h is set smaller for the small ink droplet 12*b* and set larger for the large ink droplet 12*a*.

Figure 7:
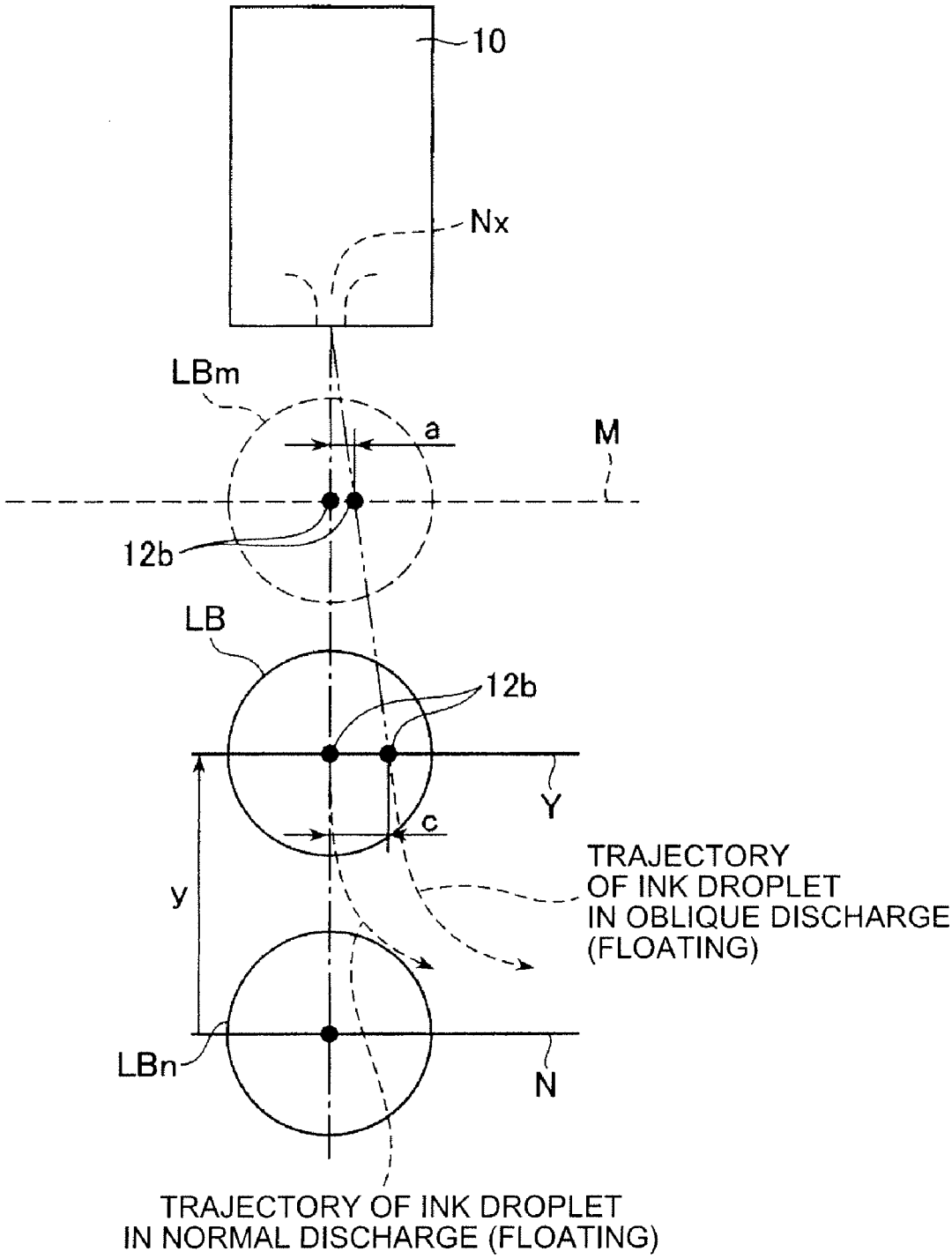
FIG. 7 is a schematic diagram for explaining detection of a small ink droplet by using the liquid-discharge-failure detecting apparatus shown in FIG. 1.

FIG. 7 is a schematic diagram for explaining detection of the small ink droplet 12*b* by using the liquid-discharge-failure detecting apparatus 16. The small ink droplet 12*b* floats due to its smallness and low discharge speed before traveling for a long distance. Therefore, the base 21 is moved up closer to the head nozzle surface 11 by a distance y, so that the laser beam LB travels on a level Y where the small ink droplet 12*b* is not floating. If the small ink droplet 12*b* is discharged in the oblique manner at an angle equivalent to the oblique angle shown in FIG. 3, a displacement amount c on the level Y is smaller than the displacement amount b on the level N shown in FIG. 3 but larger than the displacement amount a on the normal printing surface M. Therefore, the optical output value decreases by an amount that is larger than $\Delta V_A$.

Figure 8A:
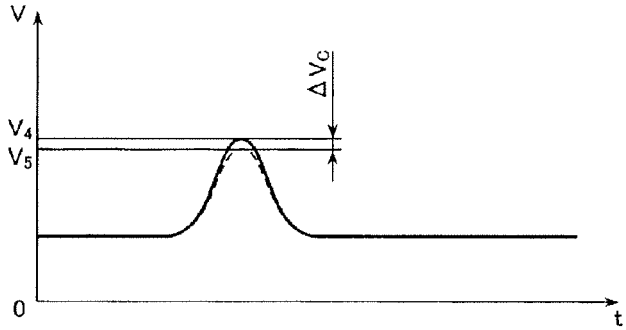
FIG. 8A depicts optical output characteristics on a normal printing surface shown in FIG. 7.
Figure 8B:
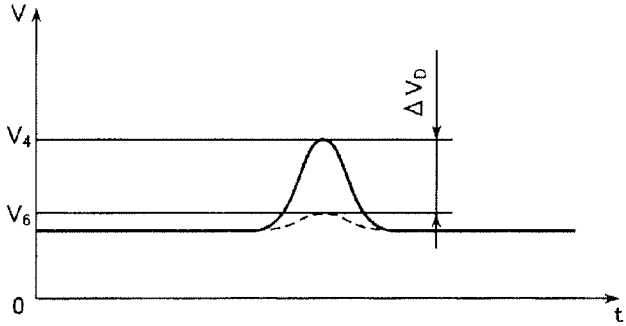
FIG. 8B depicts optical output characteristics on a higher level than the normal printing surface show in FIG. 7.

FIG. 8A depicts optical output characteristics on the normal printing surface M; and FIG. 8B depicts optical output characteristics on the level Y that is closer to the head nozzle surface 11 than the level N by the distance y. The horizontal axis is time t since the small ink droplet 12*b* is discharged, and the vertical axis is optical output value V. The laser beam LB travelling on the level Y is called laser beam LBy.

As shown in FIG. 8A, on the normal printing surface M, the optical output value in the normal discharge is $V_4$, because the hit position is at the center having the highest intensity. On the other hand, the optical output value in the oblique discharge decreases to $V_5$ by $\Delta V_C$ (i.e., $V_4>V_5$), because the hit position is displaced by the displacement amount a. On the other hand, as shown in FIG. 8B, on the level Y, the optical output value in the oblique decreases to $V_6$ by $\Delta V_D$ (i.e., $V_4>V_5>V_6$), because the displacement amount c is larger than the displacement amount a.

When the oblique discharge occurs, the amount of change in the optical output value on the normal printing surface M is $\Delta V_C$, while the amount of change on the level Y is $\Delta V_D$, where $\Delta V_D$ is larger than $\Delta V_C$. In other words, the change appears more obviously on the level Y than on the normal printing surface M. Therefore, when the small ink droplet 12*b* is to be detected, the level on which the laser beam LB travels is preferably displaced from the level for detecting the large ink droplet 12*a* close to the head nozzle surface 11.

In this manner, the liquid-discharge-failure detecting apparatus 16 that is incorporated in the inkjet recording apparatus includes the distance changing unit 20 that changes the distance h between the head nozzle surface 11 and the optical axis L of the laser beam LB. When the inkjet recording apparatus uses an ink droplet with a small diameter as the ink droplet 12 for, for example, high-quality print, the distance changing unit 20 changes the distance h to a value small enough to detect the liquid discharge failure including the oblique discharge accurately.

It is preferable that the distance changing unit 20 changes the distance h based on both the diameter and the discharge speed of the ink droplet 12 so that the laser beam LB travels on such a level beyond which the ink droplet 12 falls down in the vertical direction instead of traveling in the discharge direction (hereinafter, "free-falls"). The distance changing unit 20 changes the distance h each time when the diameter or the discharge speed is changed. If three types of diameters including large, medium, and small are prepared, the number of setting values for the distance h can be, for example, two, one for both large and medium and the other for small, instead of three.

Although the distance changing unit 20 moves the base 21 up and down, i.e., moves the optical device 24 including the LD unit 22 and the PD unit 23 in the discharge direction in the first embodiment, it can be configured to move the liquid-droplet-discharge surface up and down instead of the optical device. Moreover, the liquid-discharge-failure detecting apparatus can be configured to include a plurality of light-emitting elements and light-receiving elements, and switch the light-emitting elements and the light-receiving elements depending on the diameter and the discharge speed. In producing the liquid-discharge-failure detecting apparatus including the light-emitting elements and the light-receiving elements, although additional parts will increase the costs, the entire costs will be low because of saving of the mechanism designed to move the single light-emitting element and the single light-receiving element.

Figure 9:
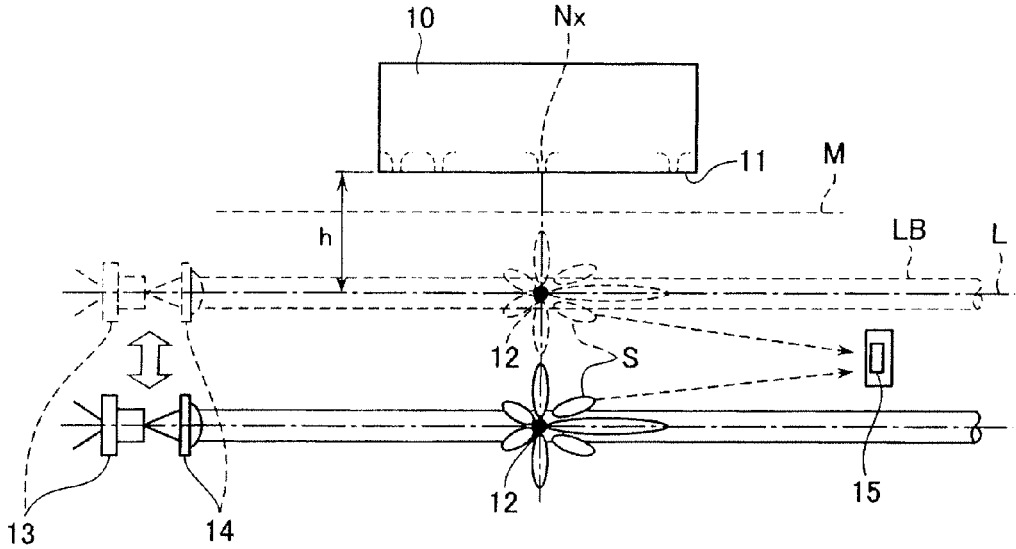
FIG. 9 is a schematic diagram of a liquid-discharge-failure detecting apparatus incorporated in an inkjet recording apparatus according to a second embodiment of the present invention.

Furthermore, the liquid-discharge-failure detecting apparatus can be configured to include a plurality of light-emitting elements and a single light-receiving element or a single light-emitting element and a single light-receiving element, and changes the light-emitting elements or moves only the single light-emitting element. Because the light-receiving element is arranged to receive the scattered light S, it is unnecessary for the light-receiving element to being on the optical axis of the light beam and directly receiving the laser beam. The structure of a liquid-discharge-failure detecting apparatus according to a second embodiment of the present invention is described with reference to FIG. 9. In the second embodiment, the light-emitting element 13 is movable while the light-receiving element 15 is fixed. The light-receiving element 15 is located in the middle of two lines between which the optical axis L of the laser beam LB is switched. Thus, the light-receiving element 15 can receive the scattered light S with the substantially equivalent intensity.

In this manner, the difference in the optical output values increases, as the distance between the liquid-droplet-discharge surface and the optical axis of the laser beam increase, and the large difference makes an occurrence of the oblique discharge obvious. Therefore, the distance between the liquid-droplet-discharge surface and the optical axis of the laser beam is increased as much as possible based on the diameter and the discharge speed.

Figure 10:
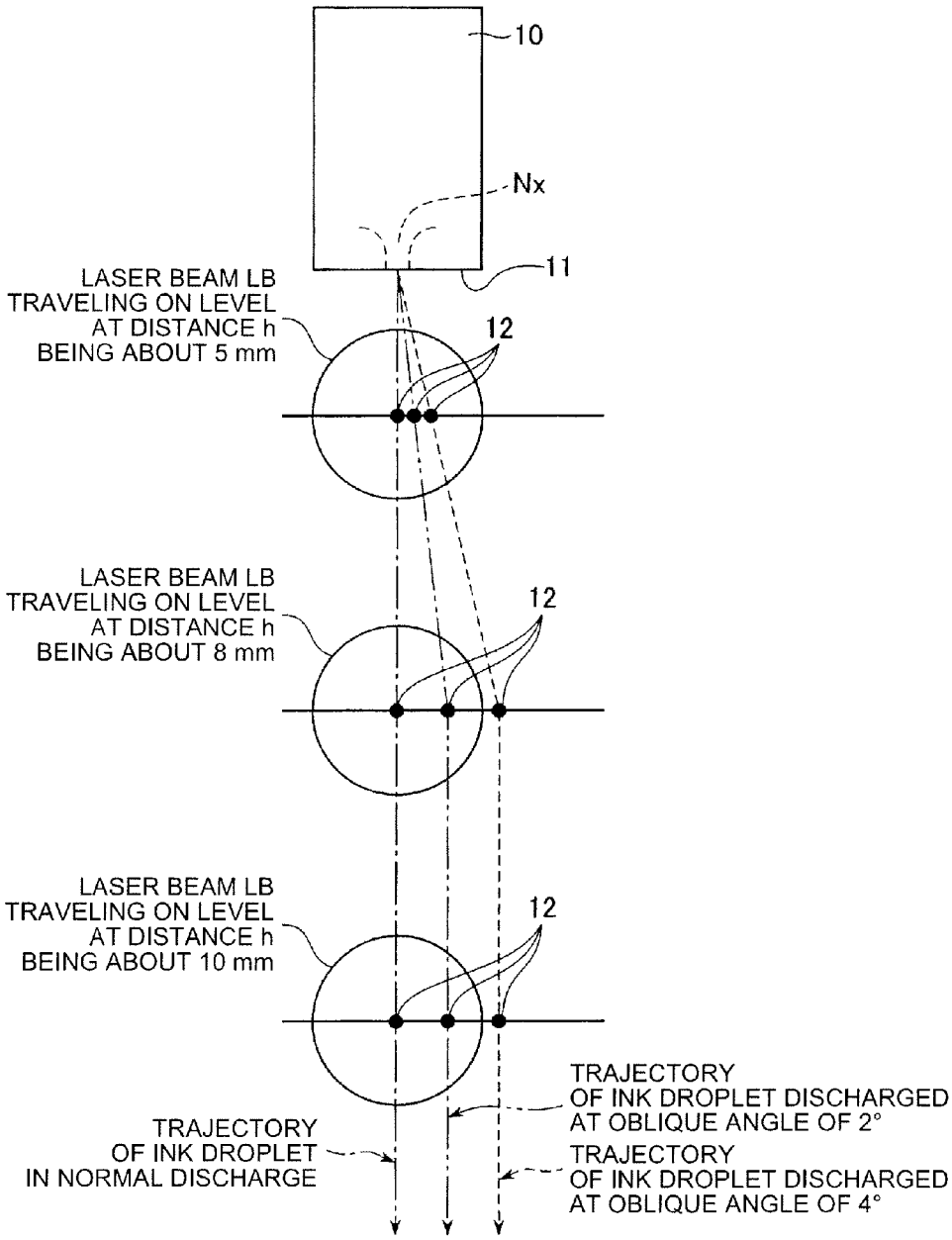
FIG. 10 is a schematic diagram of trajectories of the ink droplet discharged from the nozzle on an inkjet head at various oblique angles.

FIG. 10 is a schematic diagram of trajectories of the ink droplet 12 discharged from the nozzle Nx on the inkjet head 10 at various oblique angles. The oblique angle is measured from a trajectory in the normal discharge, assuming that the oblique angle in the normal discharge is 0°.

If the laser beam LB travels on the level at the distance h being about 5 mm, the ink droplet 12 discharged at the oblique angle of 4° can be detected. However, if the laser beam LB travels on the level at the distance h being about 8 mm or about 10 mm, the ink droplet 12 discharged at the oblique angle of 4° cannot be detected. After the ink droplet 12 travels about 8 mm, the ink droplet 12 is curved gradually due to the influence of gravity and finally free-falls.

Figure 11:
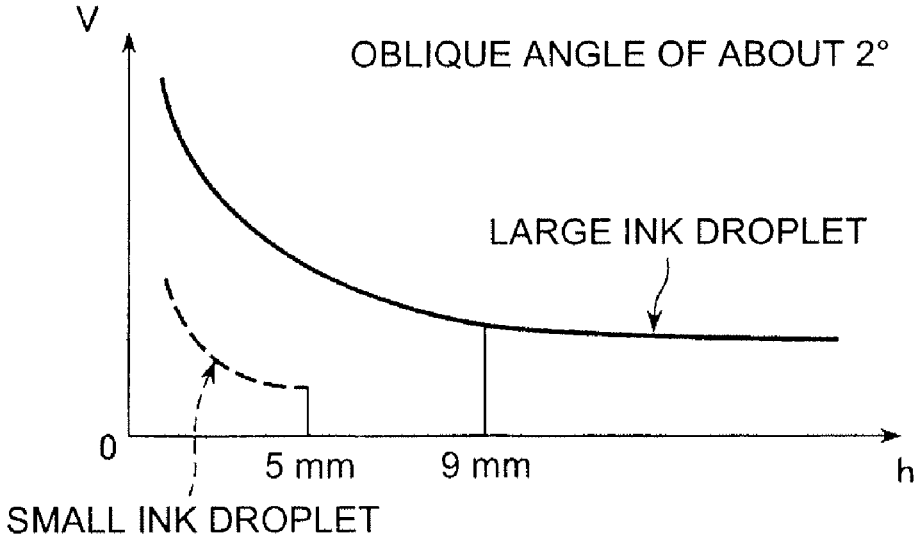
FIG. 11 is a graph for explaining a relation between distance between the head nozzle surface and an optical axis of the laser beam and the optical output value in both a large ink droplet and a small ink droplet at the oblique angle of about 2°.

FIG. 11 is a graph for explaining a relation between the distance h and the optical output value in both the large ink droplet 12*a* and the small ink droplet 12*b* at the oblique angle of about 2°. The oblique angle of about 2° is an important value because, if the oblique angle is larger than 2°, human eyes can recognize the displacement on the recording medium. It is clear from FIG. 11 that, in case of the large ink droplet 12*a*, the optical output value becomes constant at the distance h of 9 mm or larger. This is because the large ink droplet 12*a* free-falls after traveling about 9 mm away from the head nozzle surface 11. Therefore, it is necessary to set the distance h to a value smaller than 9 mm for the large ink droplet 12*a*. On the contrary, the small ink droplet 12*b* starts floating after traveling only about 5 mm from the head nozzle surface 11. Therefore, it is necessary to set the distance h to a value smaller than 5 mm for the small ink droplet 12*b*.

It is possible to detect an occurrence of the oblique discharge by emitting the laser beam to the free-falling ink droplet. However, it is impossible to calculate the displacement amount on the recording medium from the data obtained from the free-falling ink droplet. Therefore, it is necessary to emit the laser beam to the ink droplet before free-falling.

Consequently, if the ink droplet with the diameter of about 40 μm and the discharge speed of about 10 mm/s is used, maximum detection performance is obtained at the distance h of about 9 mm or larger. On the other hand, if the ink droplet with the diameter of about 20 μm and the discharge speed of about 6 mm/s is used, maximum detection performance is obtained at the distance h of about 5 mm or larger.

If the distance h is set to a value smaller than 9 mm, although a range of the oblique angle to be detected is wide, the change in the optical output value is small, which decreases the accuracy of detection. On the other hand, if the distance h is set to about 9 mm, although the range of the oblique angle to be detected decreases, the large change in the optical output value is obtained in response to the slight oblique angle, which makes it possible to implement detection with serious conditions.

The inkjet recording apparatus can be configured to include a stand-alone recovery unit. After the liquid-discharge-failure detecting apparatus detects a faulty discharge part in the above manner, the stand-alone recovery unit recovers the faulty discharge part based on a result of detection by cleaning, continuous discharging, or partial suction. As a result, the consumption of ink is suppressed, and the time is saved.

In addition to the occurrence of oblique discharge, the liquid-discharge-failure detecting apparatus can detect the occurrence of misdischarge from no change in the optical output value.

According to an aspect of the present invention, in a liquid-discharge-failure detecting apparatus, a distance changing unit changes a distance between a liquid-droplet-discharge surface and an optical axis of a laser beam to an optimum value, so that a large change appears in an output value obtained by a light-receiving element in the event of a liquid discharge failure. In this manner, the cost-reduced liquid-discharge-failure detecting apparatus with the small number of optical elements accurately detects the liquid discharge failure including an oblique discharge.

Moreover, the distance changing unit increases the distance when a discharge speed of a droplet of liquid is fast, and decreases the distance when a discharge speed of a droplet of liquid is slow. This makes is possible to accurately detect the liquid discharge failure, especially, the oblique discharge.

Furthermore, if a droplet with a small diameter and a low discharge speed is discharged, the droplet is detected before the droplet starts floating by influence of airflow caused by a fan or a heat source. This makes it possible to detect the liquid discharge failure including the oblique discharge from the large change appears in the output value.

Moreover, an inkjet recording apparatus including the liquid-discharge-failure detecting apparatus capable of accurately detect the liquid discharge failure including the oblique discharge.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid-discharge-failure detecting apparatus that detects a liquid discharge failure from a liquid-droplet-discharge surface, the liquid-discharge-failure detecting apparatus comprising:

a light-emitting element that emits a beam onto a droplet of liquid discharged from the liquid-droplet-discharge surface with an optical axis of the beam making a right angle with a direction in which the droplet is discharged;

a light-receiving element that receives a scattered light generated by scattering of the beam by the droplet and outputs a signal indicative of an intensity of received scattered light;

a failure detecting unit that detects the liquid discharge failure by analyzing the signal output from the light-receiving element; and a distance changing unit that changes a distance between the liquid-droplet-discharge surface and the optical axis of the beam.

2. The liquid-discharge-failure detecting apparatus according to claim 1, wherein the distance changing unit changes the distance based on a diameter of the droplet.

3. The liquid-discharge-failure detecting apparatus according to claim 1, wherein the distance changing unit changes the distance based on a discharge speed of the droplet.

4. The liquid-discharge-failure detecting apparatus according to claim 1, wherein the distance changing unit changes the distance so that the beam strikes the droplet right before the droplet starts free-falling.

5. An inkjet recording apparatus comprising a liquid-discharge-failure detecting apparatus that detects a liquid discharge failure from a liquid-droplet-discharge surface, the liquid-discharge-failure detecting apparatus including a light-emitting element that emits a beam onto a droplet of liquid discharged from the liquid-droplet-discharge surface with an optical axis of the beam making a right angle with a direction in which the droplet is discharged;

a light-receiving element that receives a scattered light generated by scattering of the beam by the droplet and outputs a signal indicative of an intensity of received scattered light;

a failure detecting unit that detects the liquid discharge failure by analyzing the signal output from the light-receiving element; and a distance changing unit that changes a distance between the liquid-droplet-discharge surface and the optical axis of the beam.

* * * * *